United States Patent [19]

Reiner et al.

[11] 3,949,517

[45] Apr. 13, 1976

[54] POWER SUPPLY TOY AND MOTORIZED VEHICLE

[75] Inventors: Lawrence L. Reiner, Woodbury, N.Y.; John P. McNett, Short Hills, N.J.

[73] Assignee: Lawrence L. Reiner, Woodbury, N.Y.

[22] Filed: Oct. 4, 1974

[21] Appl. No.: 512,087

[52] U.S. Cl. ..... 46/45; 46/243 M; 46/247; 331/11

[51] Int. Cl.[2] ..... A63H 33/27

[58] Field of Search 46/45, 243 M, 243 AV, 244 R, 46/247; 339/11

[56] References Cited

UNITED STATES PATENTS

| | | | |
|---|---|---|---|
| 2,311,276 | 2/1943 | Wilcox | 339/11 |
| 3,199,249 | 8/1965 | Carver et al. | 46/247 |
| 3,229,421 | 1/1966 | Ostrander | 46/247 |
| 3,471,963 | 10/1969 | Tomiyama | 46/243 LV |
| 3,733,744 | 5/1973 | Hiltpold et al. | 46/243 LV |

*Primary Examiner*—Louis G. Mancene
*Assistant Examiner*—Robert F. Cutting
*Attorney, Agent, or Firm*—Lackenbach, Lilling & Siegel

[57] ABSTRACT

A toy power supply having a battery power pack and a pair of conductive leads extending therefrom; each lead having an output contact element connected thereto and the electrical output contact elements may be individual elements or form part of a glove, mitten or prong-like electric power wand or "prod". The output contact elements are compatible with pairs of input contact elements on electrically actuated toys and accessories, such as dolls and vehicles. In operation, the output contact elements operate in effect as a kind of switch, and upon said contacts properly engaging a pair of input contact elements of a toy, whatever toy one is operating will then start to function, whether it is a motor or light or other accessory.

11 Claims, 25 Drawing Figures

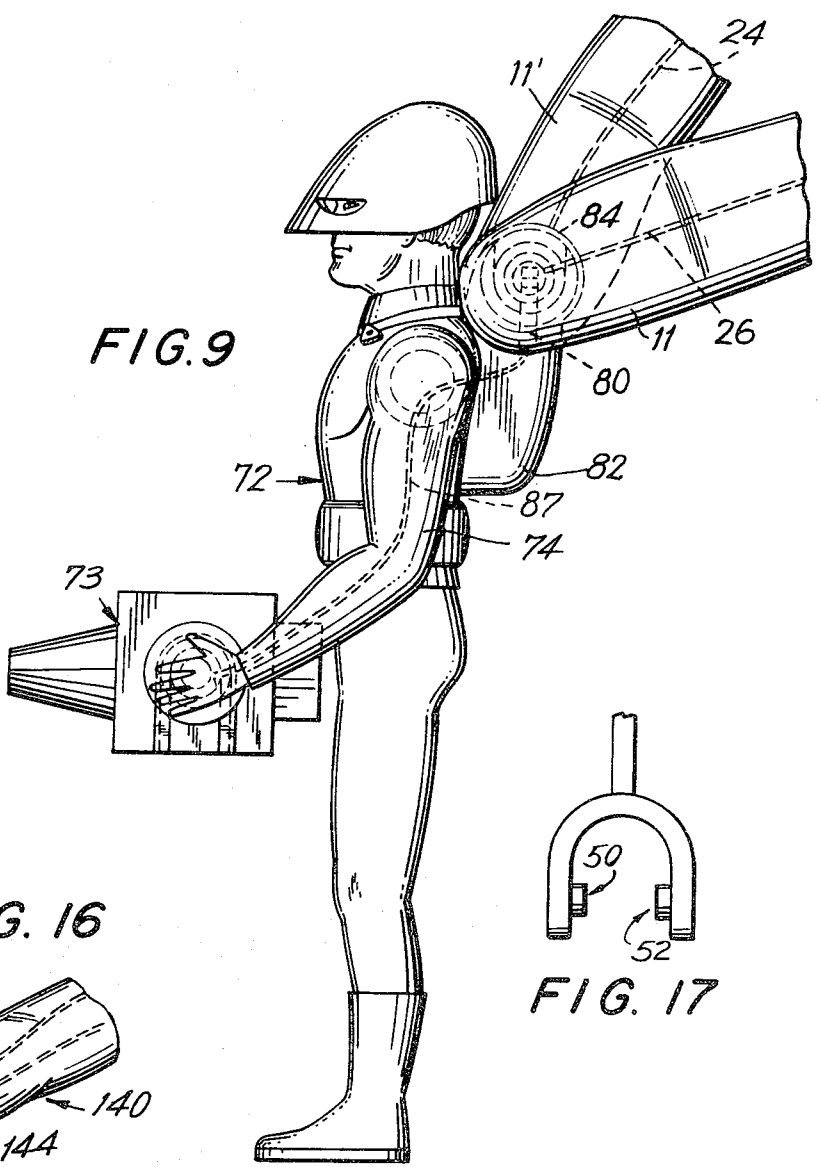
FIG. 9
FIG. 17
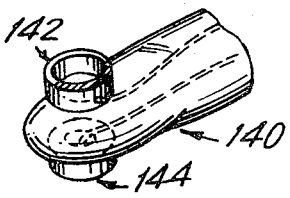
FIG. 16
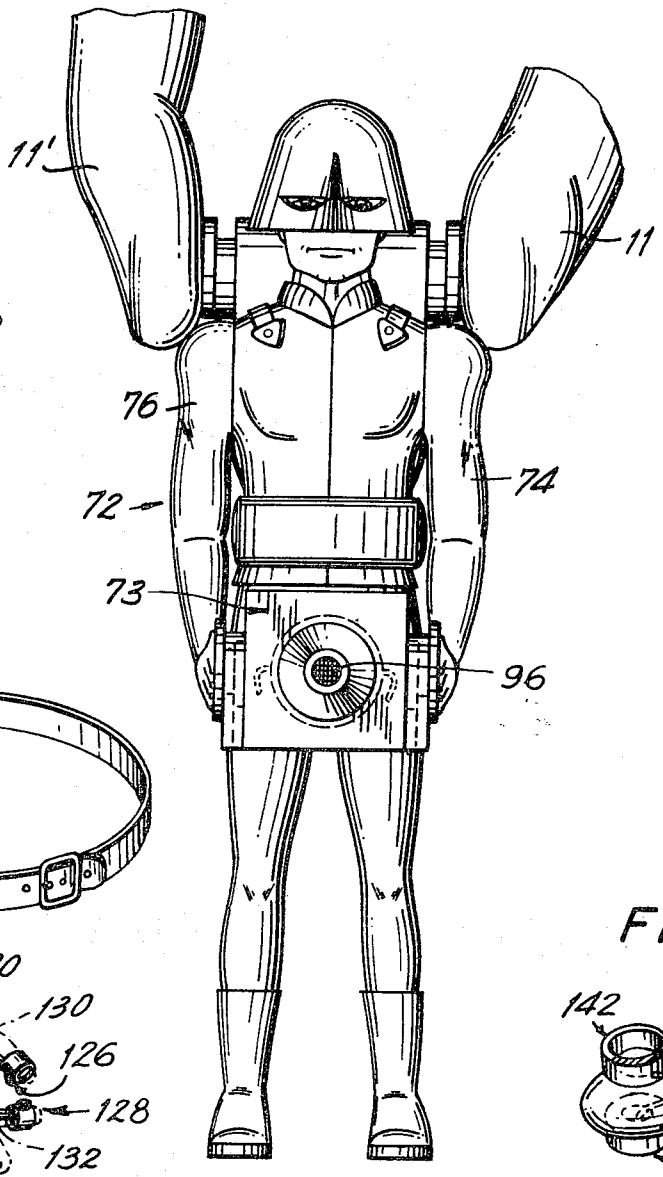
FIG. 8
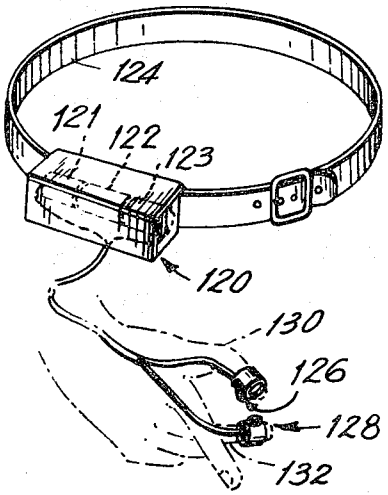
FIG. 15

26
62
56
11
50
224
222
218
214
208
206
204
202
210
212
216
220
226
200
56
11
24
25
60
201
242
244
238
248
250
246
240
25

26
11
232
200
230
24
11'
201
24
228

11'
236
232
246
234
250
201
242
240
228
24

POWER SUPPLY TOY AND MOTORIZED VEHICLE

BACKGROUND OF THE INVENTION

This invention relates to electrically operated toys, and more particularly to a hand-operated powerglove-like device adapted to be used in conjunction with many different types of toys for providing electrical energization thereto.

Although there are numerous toys presently on the market which are of the motorized type, generally speaking these toys are cumbersome since they must incorporate a power source in the toy itself or the toys must be wired to an adjacent power supply source. These toys which are of the self-contained type are invariably heavier and are usually larger in size than other like toys which are not self-contained. Moreover, with a device having a separate power supply, the toy must be operated within the confines of its connecting leads. These handicaps are disadvantageous in that they tend to be distractive and restrict the operator's freedom in playing with the toys in a more challenging and educational way by manipulation requiring both mental and physical dexterity.

Furthermore, other well-known toys are provided with key-operated wind-up springs for storing energy to operate a toy. These toy devices are also objectionable in that they do not simulate scaled down versions of life-sized objects since they do not lend themselves to providing sufficient realism to the toys nor do they serve to be very entertaining and enjoyable for the children playing with such toys.

SUMMARY OF THE INVENTION

It is, therefore, a principal object of the present invention to provide a toy object of the electrically operated type which is equipped with a novel battery power pack system.

It is another object of the present invention to provide a toy device in the form of a power supply system which is adapted to energize a plurality of electrically operated toys, vehicles, cycles, walking dolls, accessories, or the like.

It is a further object of the present invention to provide a power source in the form of a glove, mitten or wand-like shape which is connectable to the toys by means of a pair of electrical contacts.

It is still a further object of the present invention to provide a power supply toy construction and mating toy devices having the advantageous characteristics mentioned in the preceding paragraph, which are relatively simple in structure so as to be capable of economic manufacture by mass production techniques and one which is extremely durable.

These and other objects of the present invention will become apparent and will be more fully understood upon reading the following specification and referring to the accompanying drawings, which form a material part of this disclosure.

The invention, accordingly, consists in the features of construction, combination of elements, and arrangement of parts which will be exemplified in the construction hereinafter described, and, of which the scope will be indicated by the appended claims.

BRIEF DESCRIPTION OF THE DRAWINGS

FIG. 8 is a front elevational view of a toy doll holding an accessory toy device, and illustrating the positioning of the output contact elements on the toy doll for energizing the toy doll and/or the accessory device;

FIG. 9 is a side elevational view of the toy doll of FIG. 8, showing in phantom the electrical connections between each of the elements, beginning with the output contact elements at the extremities of the thumb and index finger, and ending at the input contact elements of the accessory toy device;

FIG. 15 is a perspective view of an alternate embodiment of the invention illustrating a modified power supply system, wherein the output terminal contact elements are in the form of tubes or cup-shaped sleeves, such as "thimbles" and the power pack is remotely disposed on a belt;

FIG. 16 is another alternate embodiment showing a single prong-like extension having on opposite side faces a pair of output terminal contact elements for engagement with a pair of input terminal contact elements situated in a recess of a compatible toy device;

FIG. 17 is a further alternate embodiment showing a wand, which may be hollow for accommodating a finger, having a pair of output terminal contact elements facing each other and being separated by a fixed distance;

DESCRIPTION OF THE PREFERRED EMBODIMENTS

Figure 1:
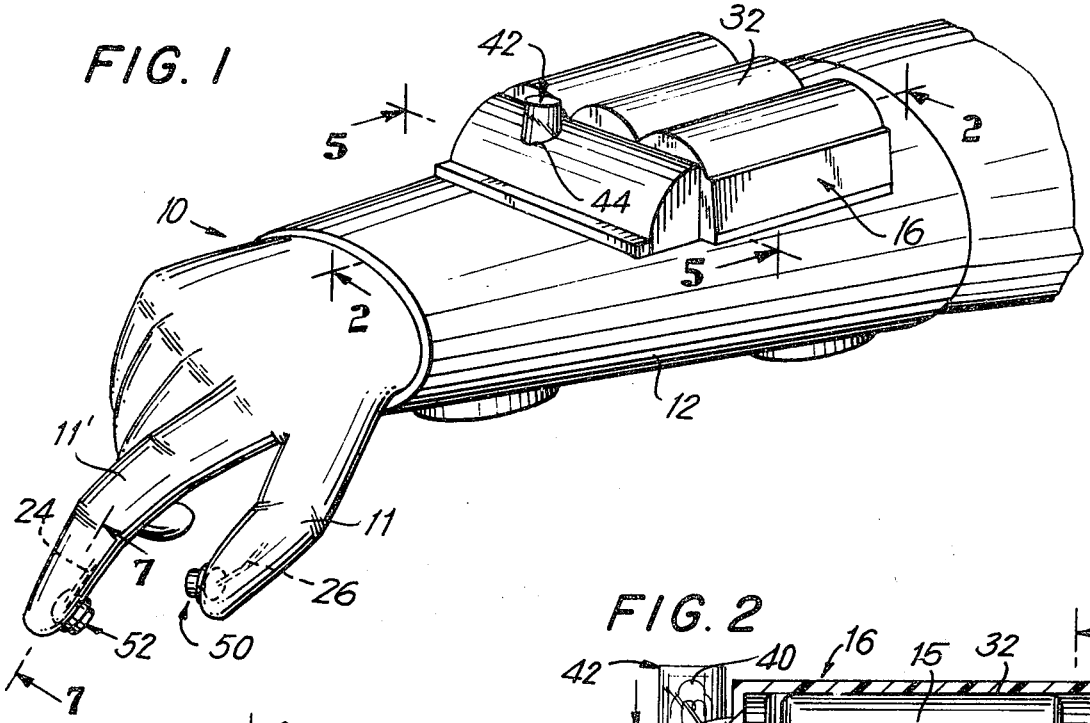
FIG. 1 is a perspective view of a power supply system of the present invention, in the form of a powerglove-like article having a built-in power pack.

Referring now to the drawings, and more particularly to FIGS. 1–5, the powerglove toy of the present invention is generally illustrated by the reference numeral 10. A gauntlet portion 12 of the glove 10 houses a plurality of batteries, such as three conventional "C" size dry cells of the Le Clanche type, by means of a base member 16 suitably secured to or forming a part of the gauntlet portion 12. The batteries comprise a row of cells 13, 14 and 15 arranged on the base 16 in a suitable fashion, such as by being vertically stacked adjacent each other, with suitable bridging contact plates 17, 18 electrically connecting the cells in series. The end cells 13 and 15, as best showin in FIGS. 2–5, are suitably connected by end contact strips 20, 22, respectively, which in turn are suitably connected to conductive lead lines 24, 26 extending to a pair of output terminals or contact elements 50, 52 provided on a pair of fingers of said powerglove 10.

A cover 32 is provided about the base element 16 so as to provide access to the cells. It is removable by means of a co-operating front tongue or flange portion 34 positionable in a groove 36 and a mutually co-operatively associated cam locking latch element 37 and slot opening 38 in a back flange portion of the cover 32.

If desired, a test bulb or other signalling device 40 may be employed to test the cells operability. The bulb 40 is suitably disposed beneath a transparent or translucent push-button 42 passing through an aperture 44 in the cover 32. The electrical test circuit is conventionally wired to the push-button make-break switch so that upon depression of the button 42, the light will be turned on if the cells of the power pack are not defective or dead. Although the electrical circuitry for such testing circuit does not form a part of the invention, it is further described for a better understanding of the invention. In addition, all three cells need not be tested, as any two adjacent cells obtain substantially the same end test result, namely, the three cells together are good or weak.

As seen in FIGS. 2–5, only cells 14 and 15 are tested. When button 42 is pressed down, an electrical circuit through such two cells is completed thereby illuminating a bulb 40 or ringing a buzzer indicating the power pack is in good operating condition. The testing electrical circuit is closed when contact is made upon depression of the button 42 since the socket wall portion of the bulb 40 is connected to a conductive leaf spring contact strip 31, which is in turn contacting the conductive strip 22 at the V-shaped bend 33 of the contact strip 31. In addition, the base of the bulb's socket also makes contact with the conductive strip 17 contacting the middle cell 14, thereby completing an electrical circuit between cells 14 and 15 from the bulb's terminals via strips 31, 22, 18 and 17.

The gauntlet 12 is preferably made of a strong durable material to support the power pack and yet is flexible so as to be conveniently wrapped about the wrist portion of one's arm. Thus, the gaunlet 12 may also be provided with suitable front and rear strap means 46 having hook-like elements 47 connectable to apertured means 48 on opposing strap portions for locking and holding the power supply source in place about the glove portion of said toy. As noted hereinbefore, the power pack may be mounted to the glove portion of the toy, by means well known to those skilled in the art.

Figure 6:
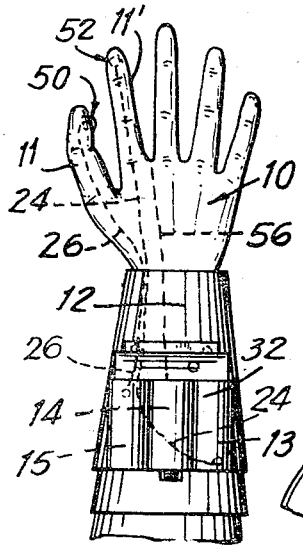
FIG. 6 is a small-scale plan view of the powerglove, showing in phantom the conductive lead lines disposed between an inner liner and the material layer forming the glove.

The glove 10 is of a construction incorporating a pair of output terminals or contact elements 50, 52 at the extremity of two fingers, preferably the thumb and another finger, and more preferably, the thumb 11 and first or index finger 11′, as best shown in FIGS. 1 and 6. The conductive leads 24, 26, which may be suitably insulated extend from the power pack to the output contact elements 50, 52. The leads 24, 26 may be provided with a suitable insulative covering, and they may extend along the outer surface of the glove 10, if desired.

Figure 2:
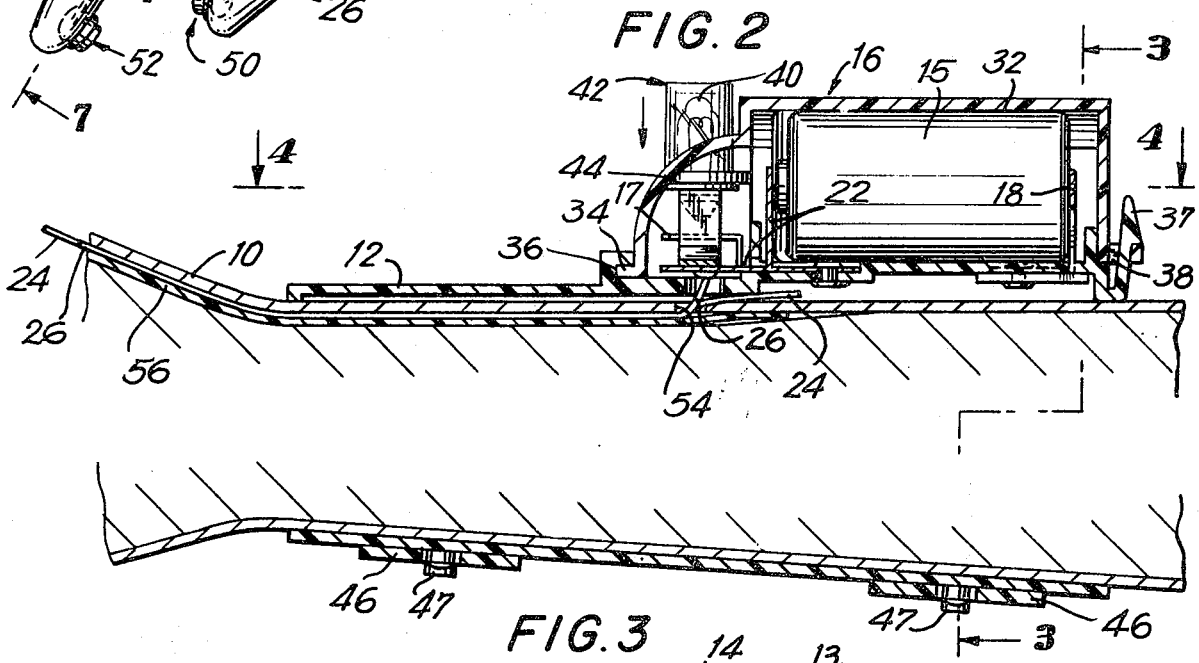
FIG. 2 is a partial longitudinal sectional view of the powerglove, taken along the line 2—2 of FIG. 1.
Figure 3:
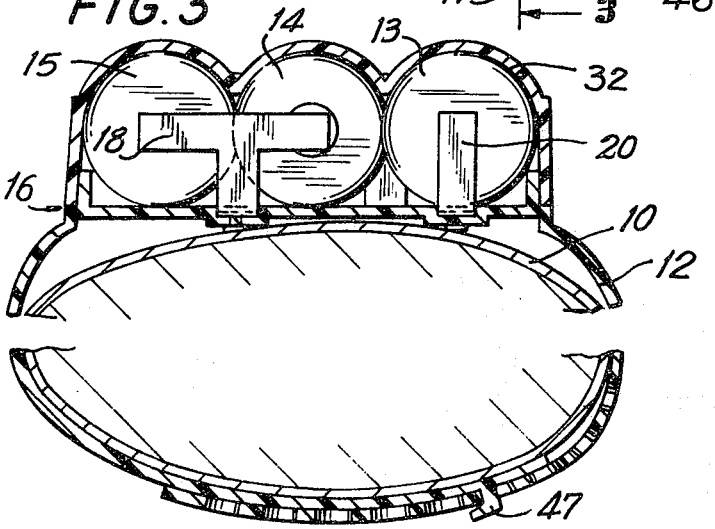
FIG. 3 is a cross-sectional view, taken along the line 3—3 of FIG. 2.
Figure 5:
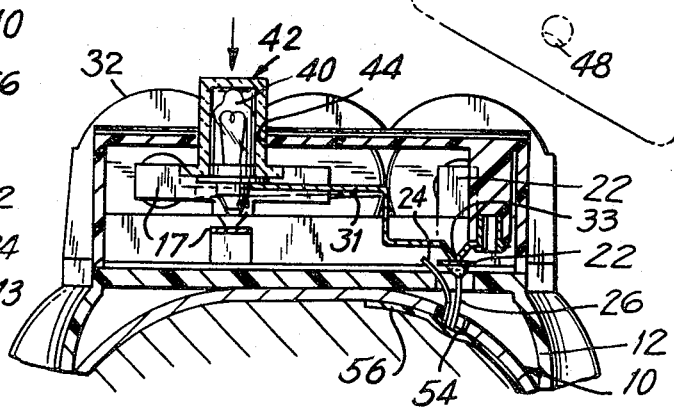
FIG. 5 is a sectional view, taken along the line 5—5 of FIG. 1.

As best shown in FIGS. 2 and 5, the leads 24, 26 extend through an opening 54 in the glove 10. These leads pass suitably between the inner wall surfaces of the glove 10 and an inner liner 56 which may extend along just those wall portions and fingers which are in juxtaposition with the extending conductive lead lines 24, 26 thereby forming a partial liner. If desired, the leads could, of course, extend outside of the glove or could even be considered as part of the glove material as embedded wires. A further alternate construction such as printed circuit leads on a plastic glove is also envisioned in the practice of the invention. The inner liner 56 and glove 10 are preferably made from nonconductive, flexible material suitably elastic as well, such as vinyl, which is also lightweight; and the liner and glove may be suitably joined together by any conventional means, as in the case of a plastic glove and vinyl liner by marginal heat seals.

Figure 7:
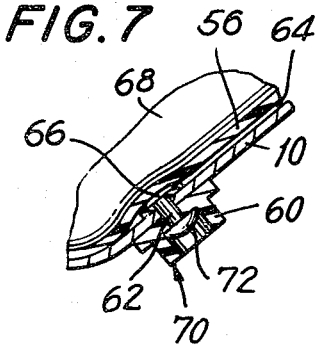
FIG. 7 is a fragmentary sectional view, on an enlarged scale of an output contact element.
Figure 4:
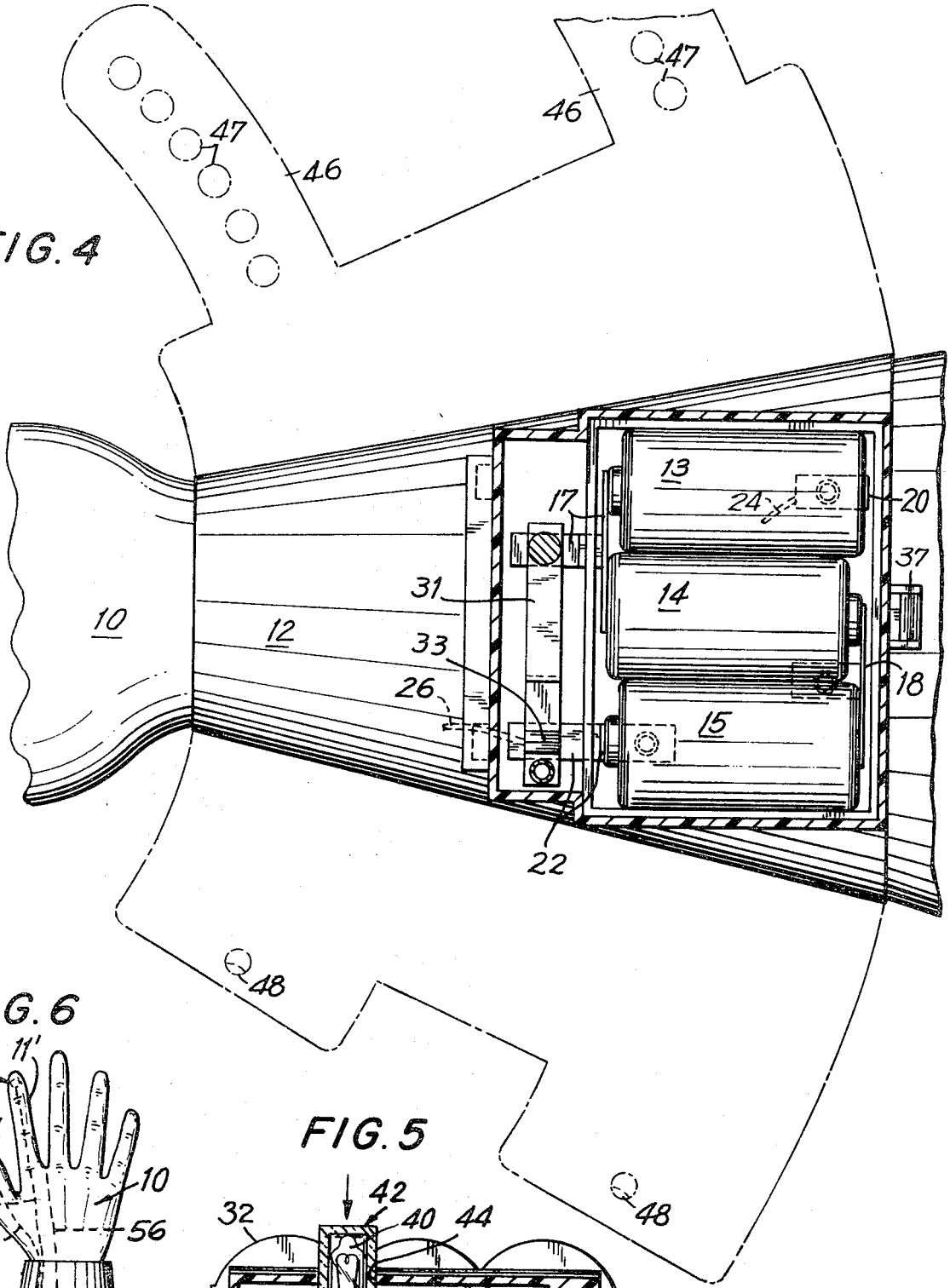
FIG. 4 is a fragmentary plan view of the powerglove of FIG. 1, with the battery pack supply system shown in section and with the wrist straps illustrated as in a development layout, but in phantom.

Contact elements 50, 52 are shown in detail in FIG. 7. As shown therein, a hollow button 60, of nonconductive material, such as styrene is held by a contact element, such as a conductive, tubular rivet 62, to the glove material 10. A conductive lead 64 having a suitable connector (not shown) at its end is also secured in electrical contact beneath the inner flattened end 66 of the rivet 62. The inner liner is shown by the reference numeral 56, and the user's finger is illustrated at 68. This electrical contact structure is the same for both output terminals or contact elements 50 and 52. Short circuiting of the contact elements 50, 52, if brought together by ones's fingers, is precluded by specifying that the height of the top peripheral wall surface 70 be greater than the height of the rivet contact head 72 in the hollow button 60.

Figure 10:
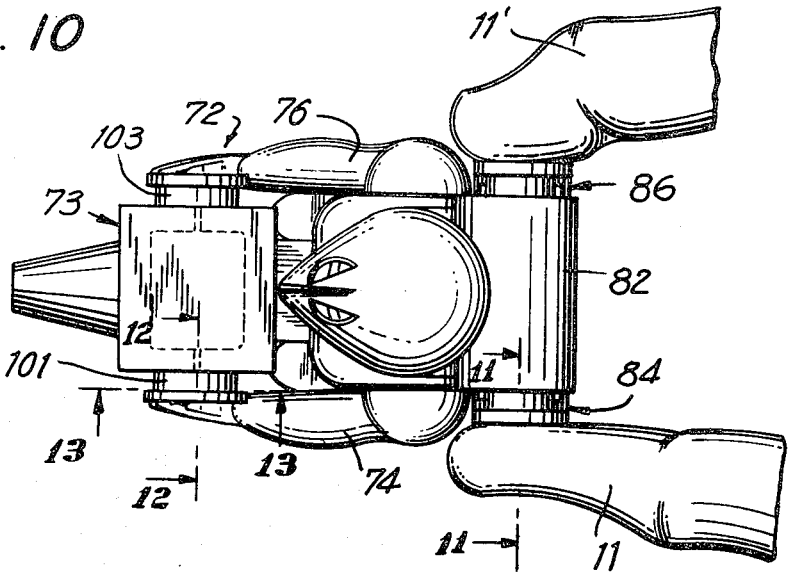
FIG. 10 is a plan view of the toy doll of FIGS. 8 and 9, showing the output contact elements in electrical contact with the input contact elements of a back-pack on the toy doll.
Figure 11:
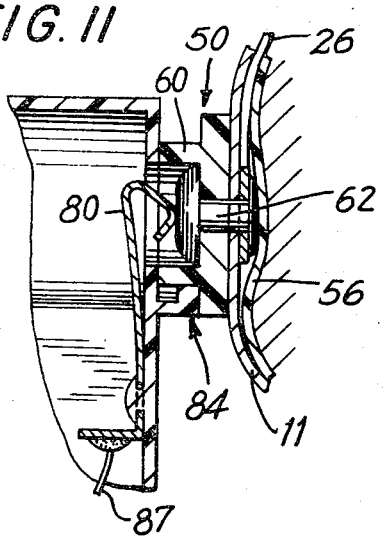
FIG. 11 is a fragmentary sectional view, taken along the line 11—11 of FIG. 10.

FIGS. 8–10 illustrate a toy "robot-like" doll 72 of the present invention having in place a removable sound- or light-generating accessory 73, a pair of generally rigid arms 74, 76 and co-operatively associated input contact elements (only one shown at 80 in FIG. 11). The contact elements are suitably for purposes of entertainment provided on a back pack 82, although they could also be provided directly on the arms 74, 76 of the toy doll 72 adjacent the shoulders thereof. A U-shaped slot 84, 86 provided about the input contact elements (80 in FIG. 11) guides and directs the output contact elements 50, 52 into firm engagement with the input contact elements. As best shown in FIG. 11, the contact element 80 is preferably in the form of a leaf spring so as to deflect into and out of the hollow button 60 as it is pushed into or pulled from electrical contact with the conductive rivet 62. Electrical contact is maintained as long as the user applies a slightly squeezing pressure maintaining positive electrical contact between the output and input contact elements. A conductive lead 87 extends from a suitable soldered contact with the contact element 80, through arm 74 to a contact element 90 provided therein in the left hand of the toy robot 72. Lead 87 is in a manner like leads 24, 26 connected to a tubular, conductive rivet 92 which in turn is brought into electrical contact with a spring-like conductive contact element 94 provided in the toy accessory 73. The removable accessory 73 shown may suitably simulate a "ray" gun by passing light from a bulb therein (not shown) through a filtering device or screen 96, or by energizing a speaker, ringing a buzzer and the like.

However, in order to insure positive electrical contact between the output terminals or contact elements of the toy robot's arms and the input contact elements of the toy accessory and to hold the toy accessory in place, flanges 98 are provided on the output contact elements which co-operate with flanges 100 on U-shaped slots 101 and 103. These flanges together lock in place the hands of the toy robot 72 to the input sockets of the accessory 73.

It will be appreciated that the toy robot 72 may be also equipped internally with a bulb behind the eye sockets and be suitably wired to the robot's contact elements so as to also light up upon electrical energization of the toy accessory 73.

Figure 13:
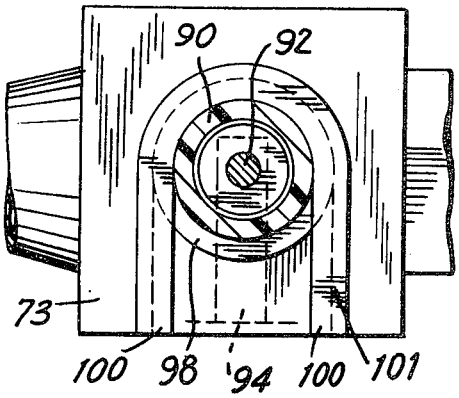
FIG. 13 is a fragmentary sectional view, taken along the line 13—13 of FIG. 10.
Figure 12:
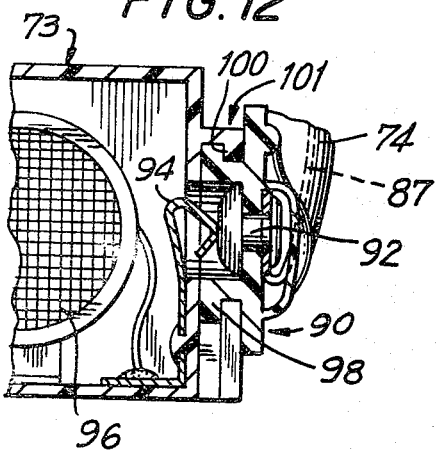
FIG. 12 is a fragmentary sectional view, taken along the line 12—12 of FIG. 10.
Figure 14:
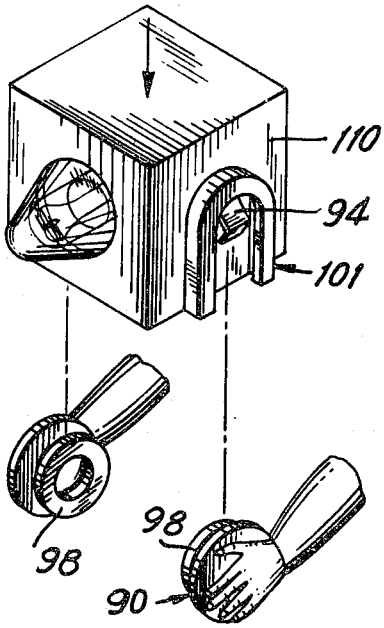
FIG. 14 is a perspective view of an alternate toy accessory, showing in greater detail the guide track means for guiding and aligning the toy doll output terminal contact elements into position electrically contacting the input terminal contact elements of the toy accessory.

In FIG. 13, the flange 100 of the U-shaped slot 101 is more clearly illustrated holding flange 98 of the contact element 90 in place after the removable toy accessory is dropped in place. Other toy accessories, such as the light box or flashlight 110 of FIG. 14, having like reference numerals for like parts, can be readily interchanged with the accessory 73 so as to provide greater entertainment value for a child playing with the toy devices of the present invention.

In FIG. 15, the power source 120, comprising three cells 121, 122, and 123 axially in line, is mounted on a belt 124 adapted to fit about the waist of a child. The hand of the child is illustrated in phantom and the contact elements 126, 128 are shown respectively disposed about the thumb 130 and the middle finger 132. The contact elements 126, 128 are suitably secured to tubular cup-shaped elements which slip over the tips of one's fingers. Thus, although a glove, mitten or other hand covering may be employed in the practice of the invention, thimble-like fingertip devices are also considered to come within the scope of the invention.

FIG. 16 shows a further embodiment of the invention wherein a probe or prod 140, which may be cup-shaped, is provided with a pair of contact elements 142, 144 on opposite sides thereof. Such device is adapted to be inserted into a mutually co-operatively associated recess in a toy doll or accessory for providing energization thereto by closing the electrical circuit of the power supply system of the invention. Of course, the output contact elements are of the same type as in the previously described powerglove embodiments, and the recess in the toy devices is essentially an "inside out" version of the pair of normally outwardly facing input contact elements, with the U-shaped guides and spring contact strip elements facing each other in a recess adapted to accommodate the wand-like probe or prod, with or without a finger hole.

In FIG. 17, another wand is shown with the output contact elements facing each other and being separated by a fixed distance by the two fork elements of the yoke-like wand shown therein. This wand, as well as the wand of FIG. 16, may, if desired, be held in one's hand during play, although it should be obvious that the wand of FIG. 17 could also be provided with a recess hole for accommodating a finger of a user. The wand of FIG. 17 may also be advantageous in that the two prongs of the fork element could be suitably made to yield or deflect slightly upon contacting a pair of outwardly facing contact elements, thereby providing a firm, squeezing pressure for positive electrical contact. Of course, it will be appreciated that with a wand or prod where the contact elements are a fixed distance from each other, the hollow, non-conductive buttons may be eliminated. Such contact elements could not be shorted out because they cannot be brought together, unless, of course, an individual bridged the gap between them with a piece of metal or other conductive object.

In operation, the operator's finger and thumb operate as a kind of open switch. As soon as a user mates the thumb and finger of the powerglove of the invention with whatever is to be operated, the toy will start to operate or function, whether it is a sound or light device, or a motorized object or whatever electrical accessory is being used. The "power" of the glove, finger tip elements or prod is transferred to the toy doll or accessory device, whether the power pack supply is remotely located on a belt or forms part of the glove itself.

It will be appreciated that in manufacturing the powerglove or powermitten of the invention, it may be easier and more economically desirable to form the output contact elements in the form of cup-shaped "thimble" finger tip elements. These tip elements would then be simply secured to the tips of a thumb and finger of a glove having a gauntlet and power supply pack.

Figure 18:
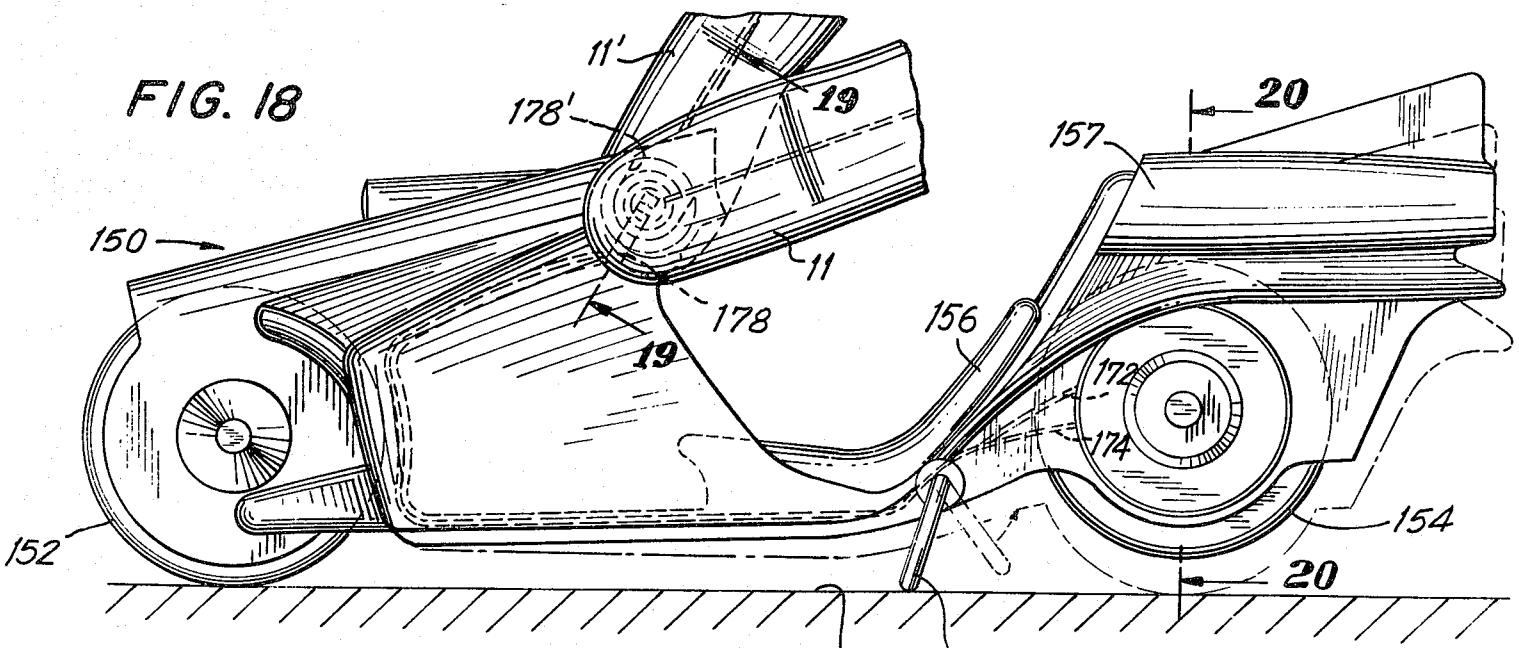
FIG. 18 is a side elevational view of a toy vehicle of the present invention, shown being electrically energized by the powerglove of FIG. 1.
Figure 20:
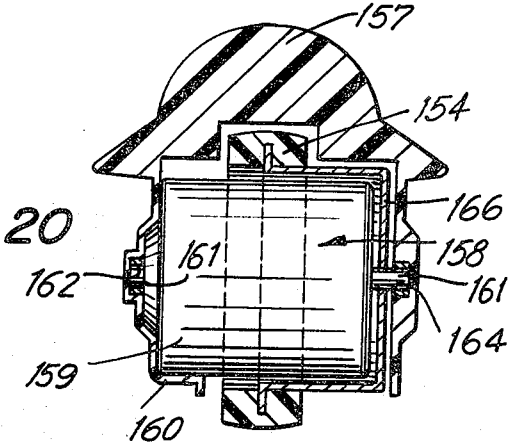
FIGS. 19 and 20 are sectional views, respectively taken along the lines 19—19 and 20—20 of FIG. 18.
Figure 19:
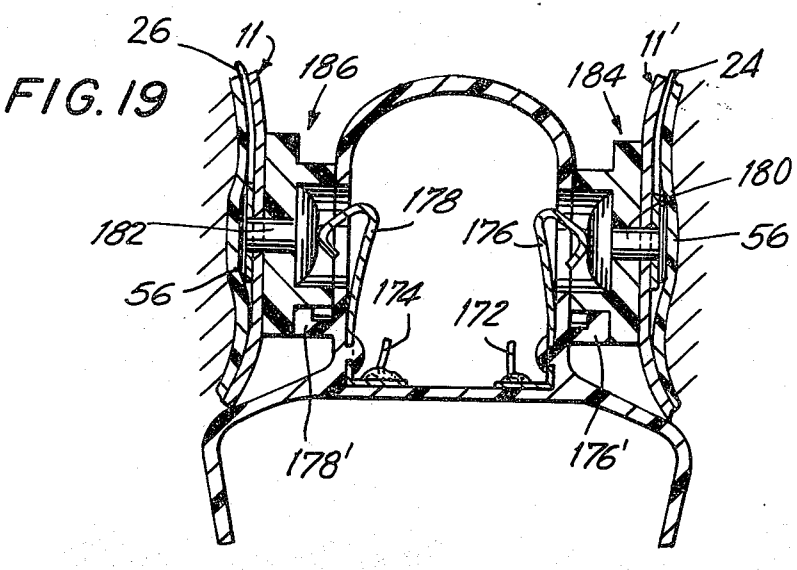

The present invention is further described hreinafter in connection with mechanized or electrically operated vehicles, robots, etc. As shown in FIGS. 18–20, a toy motorcycle 150 resting on the substrate surface 151 is provided with free wheeling front and rear wheels 152, 154, respectively, and with a seat portion 156 disposed within a chassis 157. Suitable shaft or axle means are provided to support the front and rear wheels in a rotatable manner.

Rear wheel 154 is clearly shown in FIG. 20. An electrical motor 158, having a stator 159 mounted to a casing 160 and a rotor (not shown), is supported on a shaft 161, suitably seated in shaft bearing supports having suitable sleeve bearings (unnumbered), at its ends, as at 162 and 164. A flywheel 166 forming a part of the rotor is suitably secured or forms part of the shaft 161. The flywheel may be provided with an integral tire or a separate tire may be conveniently mounted thereon by any conventional means well-known in the art.

A pivotable kick stand suitably illustrated at 170 in FIG. 18 holds the rear wheel 154 of the toy vehicle 150 raised off the ground 151 during energization of the toy device and storage of the "converted" energy in the rotating flywheel 166. Conductive paths in the form of lead wires 172 and 174 extend from the stator of the motor 158 to a pair of resilient female input contact elements 176 and 178, suitably surrounded by U-shaped flanges 176' and 178', respectively, which engage with input terminals 180 and 182, respectively, on the side of the toy vehicle 150, as best shown in FIG. 18. The terminals 180 and 182 form a part of the male output contact elements 184, 186, mounted on a thumb 11 and index finger 11' of the powerglove 10. The liner 56 shields the lead 26 in the thumb 11 and the lead 24 in the index finger 11', as well as their end terminal (U-shaped or apertured) connectors from the user's hand.

Figure 21:
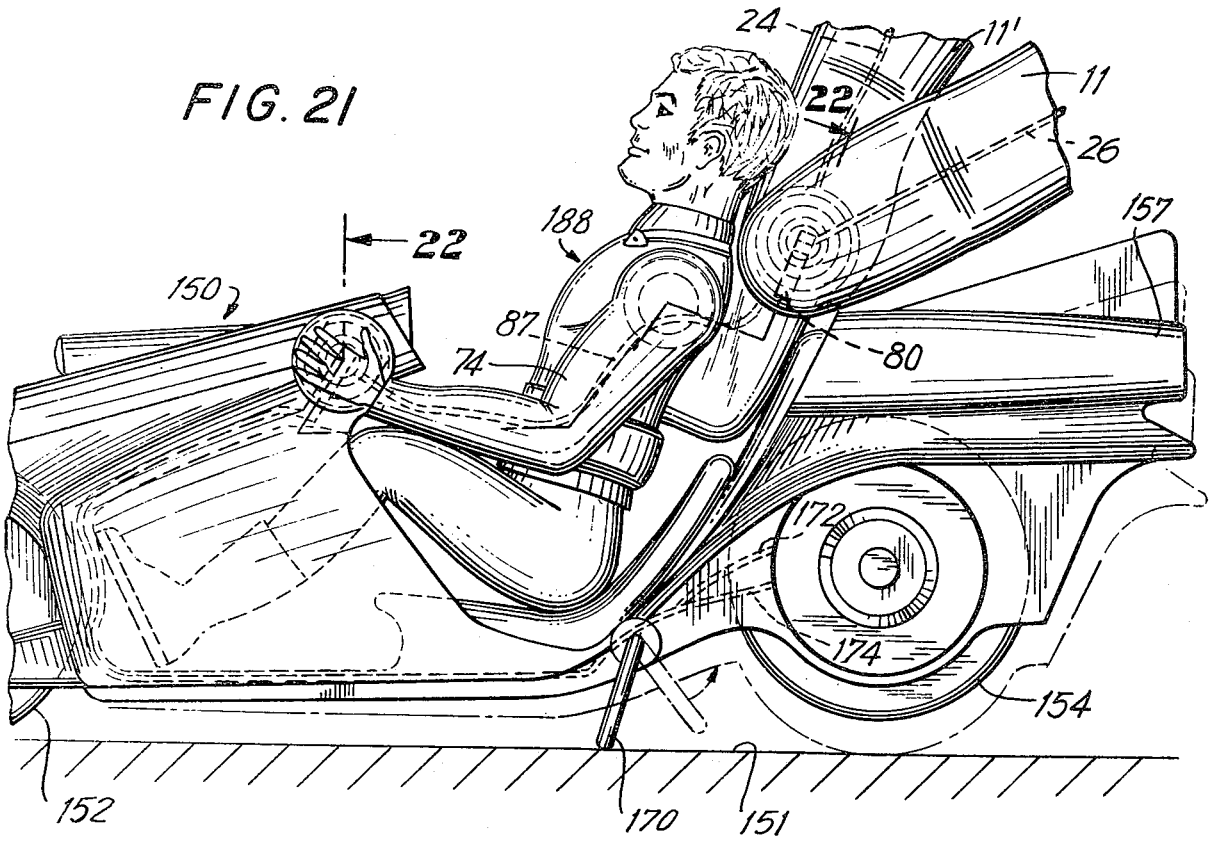
FIG. 21 is a side elevational view of the toy vehicle of FIG. 18 with a small portion of its front end cut off, shown with a toy doll seated therein, and being electrically energized by means of the doll.
Figure 22:
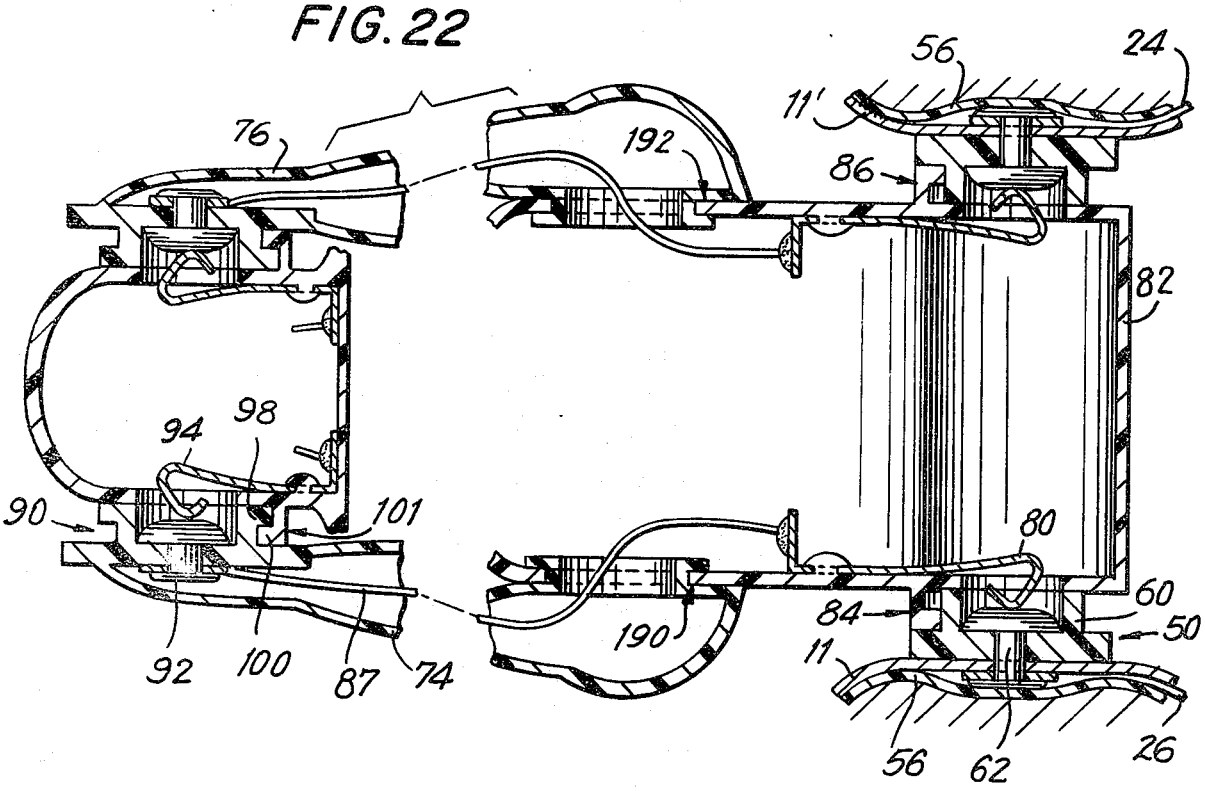
FIG. 22 is a broken sectional view, taken along the line 22—22 of FIG. 21.

In FIGS. 21 and 22, a toy doll 188 is shown seated in the toy motorcycle 150. This toy doll 188 is substantially identical to that of FIGS. 8–10 except for facial and dress features. Identification of the hands as well as all other like parts of the toy doll, including the flexible legs, will not be made and therefore hereinafter like numerals will refer to the same parts so as to simplify the description of the invention. It is noted that the arms 74, 76 may be suitably pivotably mounted as at 190, 192 in the arm socket pits, but it is not necessary for the practice of the invention. It will be appreciated that with the toy device of FIGS. 21 and 22, the energization of the flywheel (and tire) occurs indirectly, rather than directly, by the passage of electric current from the powerglove 10 through the conductive paths (only 87 shown in the left arm) in the doll 188 to the U-shaped input contact elements 176' and 178' of the toy cycle 150. To start the cycle moving, one simply removes the powerglove contacts from the input contact elements, and lifts up the kick stand 170. The cycle will thus automatically take off by virtue of the rear free spinning wheel 154 which has all of the stored kinetic energy in the flywheel after energizing same for a predetermined time.

Figures 23, 24, 25:
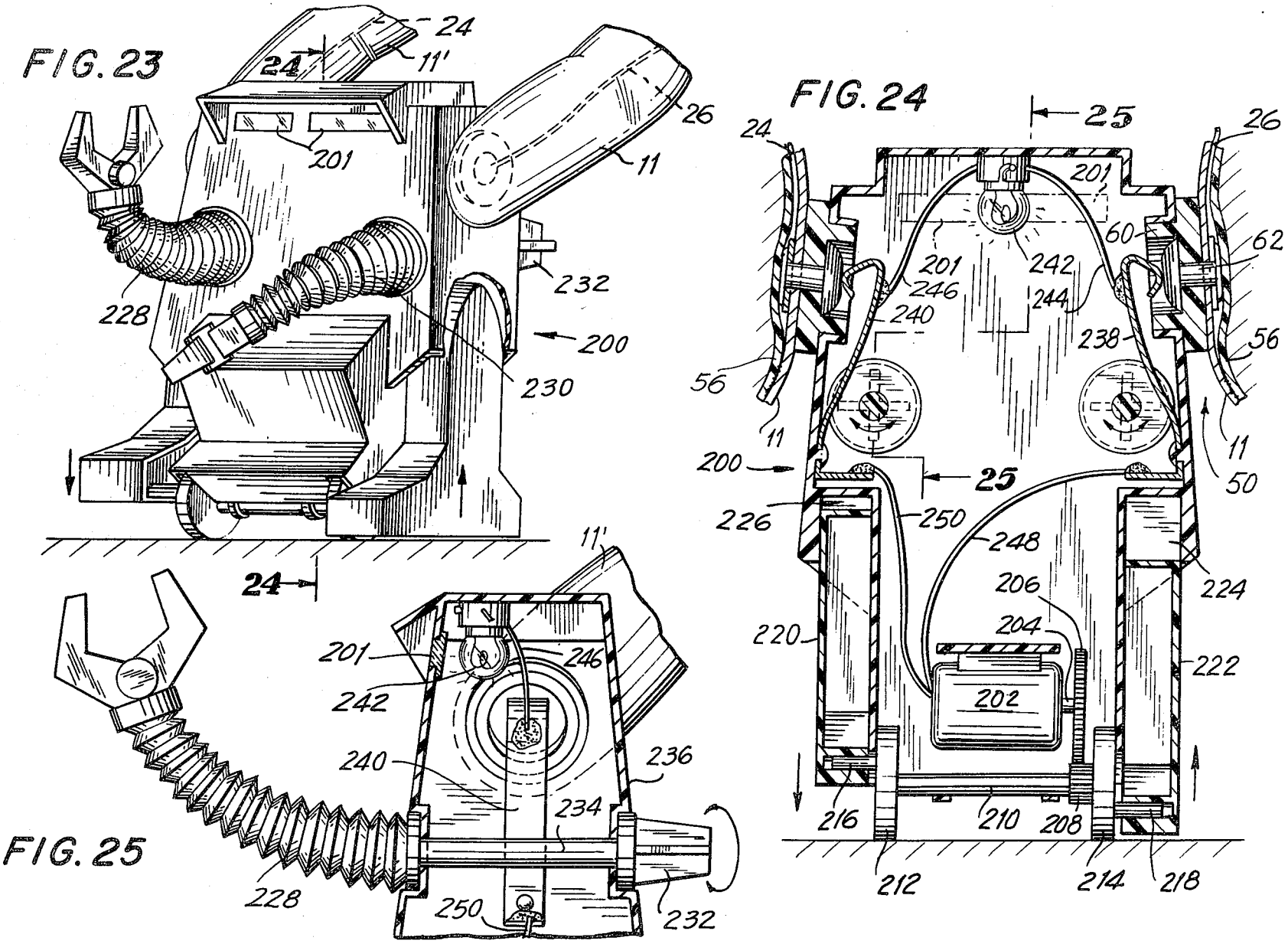
FIG. 23 is a perspective view, of an alternate toy vehicle of the invention in the form of a mechanized toy robot doll, and illustrated electrically energized by the powerglove of FIG. 18.
FIG. 24 is a sectional view, taken along the line 24—24 of FIG. 23.
FIG. 25 is a fragmentary sectional view, taken along the line 25—25 of FIG. 24.

The remaining embodiment of the invention, as illustrated in FIGS. 23–25, is a walking toy doll robot 200 having a pair of illuminating eyes 201. The robot 200 includes a motor 202 suitably mounted therein with a shaft 204 extending therefrom and having a driving gear 206 engaging a driven gear 208 mounted on wheel shaft 210. The wheels 212 and 214 are mounted by eccentric pins 216, 218 extending therefrom, and respectively mounted in movable legs 220 and 222 which move substantially upwardly and downwardly in the direction of the reference arrows, and are slidably received in respective sockets 224 and 226. The legs 220, 222 operate similar to a connecting rod extending from a pivot point, on a rotable disk, which is not located at the center of the disk.

If desired, the arms 228 and 230 may be flexible, and rotatable by means of connecting hand turning knobs 232 (one only shown disposed at the ends of a rod 234) extending from the arms and outwardly from the back 236 of the robot doll 200.

Electric current travels from the output terminals of the powerglove 10 (one only identified at 62 in FIG. 24) to the resilient, recessed input contact elements 238, 240 and then to a suitably electrically connected lamp 242 via conductive leads 244, 246 and to the motor 202 via conductive leads 248 and 250.

From the foregoing, it is seen that the powerglove, dolls and mating toy vehicles of the present invention provide a commander power toy which is extremely simple in construction, so as to be capable of economic manufacture and sale, while being uniquely attractive to children of wide physical and mental range, and which otherwise fully accomplishes its intended objectives.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

What is claimed is:

1. An electrically energized toy for use in combination with a portable power supply having a pair of output contact elements, comprising: a housing forming generally the body of said toy and having a pair of input contact elements adopted to be co-operatively associated with said output contact elements, said input contact elements having terminal elements for providing positive electrical contact with the output contact elements, electrically actuated means in said toy, and conductive paths extending between said input contact elements and said means for energizing same, thereby operating said toy.

2. The toy according to claim 1, wherein said electrically actuated means is an electric motor, and said motor is supported by said housing.

3. The toy according to claim 2, wherein said toy is a vehicle having a plurality of wheels.

4. The toy according to claim 3, wherein said vehicle is a toy motor cycle.

5. The toy according to claim 3, wherein said vehicle is a toy robot.

6. The toy according to claim 4, including a toy doll having a pair of input contact elements adapted to be cooperatively associated with said output contact elements, and having a pair of output contact elements adapted to be co-operatively associated with said pair of input contact elements on said housing of said toy; and conductive paths extending between said pairs of contact elements on said toy doll.

7. The toy according to claim 4, including a motor driven flywheel forming a part of said electric motor, and the driving means for said vehicle.

8. The toy according to claim 7, including rear wheel means secured to said flywheel.

9. The toy according to claim 8, including means for raising said rear wheel means off the surface upon which said vehicle is resting.

10. The toy according to claim 6, therein said input contact elements of said toy motorcycle and said pair of output contact elements of said toy doll are provided with means for guiding and locking said contact elements together in position for providing positive conductive paths through the mating pairs of contact elements.

11. The toy according to claim 10, wherein said input contact elements of said toy doll are resilient.

* * * * *